United States Patent [19]

King

[11] Patent Number: 4,616,937

[45] Date of Patent: Oct. 14, 1986

[54] INTERMITTENT MIXING APPARATUS

[75] Inventor: L. Tony King, Long Beach, Calif.

[73] Assignee: Komax Systems, Inc., Long Beach, Calif.

[21] Appl. No.: 723,832

[22] Filed: Apr. 16, 1985

[51] Int. Cl.[4] ..... B01F 5/06; B01F 15/02

[52] U.S. Cl. ..... 366/336; 366/339

[58] Field of Search ..... 366/336, 337, 338, 339, 366/340, 150, 167, 168, 173, 174, 177, 182; 138/38, 42

[56] References Cited

U.S. PATENT DOCUMENTS

| | | | |
|---|---|---|---|
| 3,147,717 | 9/1964 | Smith | 366/336 |
| 3,675,901 | 7/1972 | Rion | 366/336 |
| 4,114,195 | 9/1978 | Dirksing | 366/167 |
| 4,408,890 | 10/1983 | Beckmann | 366/336 |
| 4,490,048 | 12/1984 | Schlueter | 366/167 |
| 4,542,686 | 9/1985 | Bansal | 366/336 |
| 4,564,298 | 1/1986 | Gritters | 366/167 |

*Primary Examiner*—Robert W. Jenkins

*Attorney, Agent, or Firm*—Malcolm B. Wittenberg

[57] ABSTRACT

A material mixing apparatus for the mixing of two or more fluids. A tubular conduit is provided for the passage of a first fluid. A casing is caused to pass through the tubular conduit, eminating substantially radially toward the center thereof and a quill is slidably located within the casing. The quill is hollow for the passage of a second fluid therethrough and possesses a discharge port for discharging the second fluid into a stream with the first fluid when the quill is radially extended within the casing, but which is blocked by the casing when the quill is not fully extended. Downstream from the second fluid discharge port is located a mixing means for mixing the first and second fluids.

15 Claims, 3 Drawing Figures

INTERMITTENT MIXING APPARATUS

DESCRIPTION

TECHNICAL FIELD OF THE INVENTION

The present invention deals with a material mixing apparatus which contains various elements traditionally known as static mixers, for the mixing of various components of a fluid stream. The present invention differs from the prior art in combining one or more static mixers with a biasing means easily serviceable feed quill which is capable of interrupting the flow of the mixing fluid.

BACKGROUND OF THE INVENTION

It is common practice to mix particulate solids, liquids and gases with motionless mixers, having, as the name implies, no moving parts. Mixers of this category consist of baffles of various types arranged sequentially in a tube or pipe. By a process of division and recombination, separate input components can be mixed or disbursed within one another at the output of said tube or pipe.

Difficulties are often experienced, however, when mixing materials of widely disparate viscosities and/or very different flow rates. For example, in the polymer field, it is at times desirable to mix very small quantities of a low viscosity material within a much larger quantity of a high viscosity material. When this is done, the low viscosity material tends to tunnel through the mixing elements without blending with the high viscosity material to any great extent.

It is well known that one of the mechanisms that allows for the mixing of fluids is through diffusion. However, when dealing with high viscosity materials which typically produce laminar flow, diffusion rates are very small. It is known that the rate of mass transfer (N) of the diffusing component measured in moles per second, per unit area, is equal to the diffusivity (D) multiplied by the local concentration gradient (dC/dr). Thus, since (D) is small in high viscosity material, it is necessary to make the concentration gradient dC/dr large in order to maximize the value of the mass transfer rate.

A further complication in dealing with polymer and related mixing applications is that it is at times deemed desirable to interrupt the introduction of the second fluid into the first, noting that when this is done, degrading influences such as heat, cause plugging of the additive feed system.

It is thus an object of the present invention to provide a device which is capable of mixing materials having widely disparate viscosities and/or very different flow rates while providing the capability of interrupting one of the fluid streams at will, while substantially eliminating the plugging difficulties experienced by the prior art. These and further objects of the present invention will be more readily appreciated while considering the following disclosure and appended drawings wherein FIGS. 1 through 3 represent section views taken along the center of the device of the present invention, which illustrate the device in operation (FIG. 1), during feed interruption (FIG. 2), and during cleaning (FIG. 3).

Figure 1:
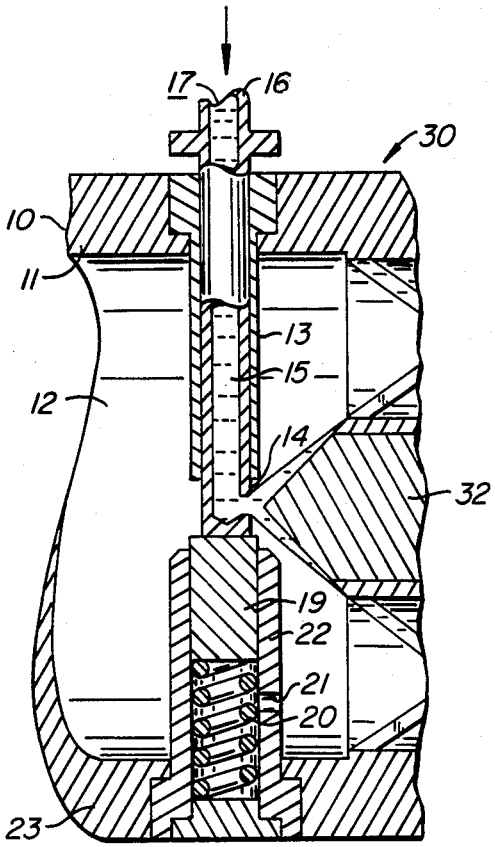
Figure 2:
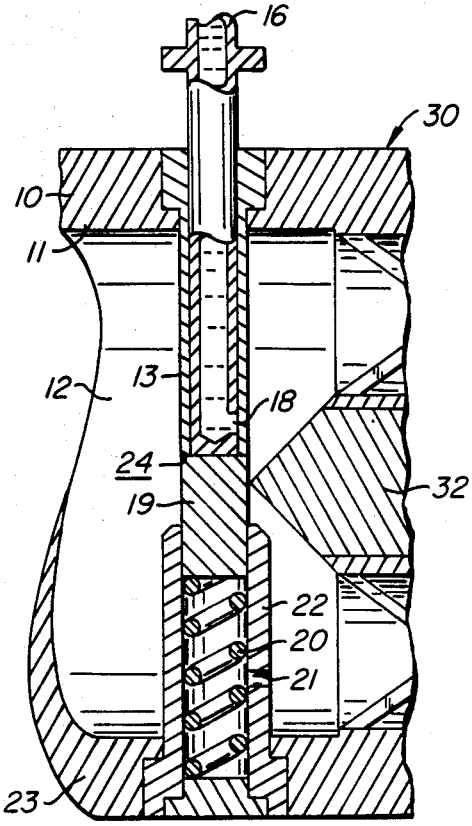

Turning first to FIG. 1, tubular conduit 10 is shown having sidewalls 11 and 23, which define area 12 for the carrying of a first fluid. In the figures, it is contemplated that the first fluid, which is not shown for the sake of simplicity in illustrating the present invention, is intended to pass within space 12, from left to right. Passing through sidewall 11 is casing 13 which emanates substantially radially toward the center of the conduit. Within casing 13 is located a slideably removable quill 16, which is hollow for the passage of second fluid 15 therein. The second fluid enters quill 16 at end 17 and progresses down the interior of the quill, until discharge point 18 is reached (FIG. 2). When quill 16 has been pressed within casing 13, until discharge port 18 at end 14 is are extended beyond the sidewalls of the casing, discharge of fluid 15 can take place.

It is contemplated in the practice of the present invention, that when radial pressure is removed from end 17 of the quill that biasing means 20 will push upon and raise the quill at least to the point where discharge port 18 is now blocked by the casing 13. To further enhance the termination of discharge of second fluid 15, ram 19 is provided between biasing means 20 and casing 13. When pressure is removed from quill end 17, ram 19 is caused to slide within biasing housing 22 to abut lower edge 24 of casing 13 (FIG. 2). As such, quill 16 and the inner area of casing 13 are substantially fluid sealed from contact with first fluid passing through area 12 in the conduit 10. Although biasing means 20 is illustrated as a spring, virtually any biasing means, including hydraulics and even manual pressure are contemplated in the practice of the present invention.

Figure 3:
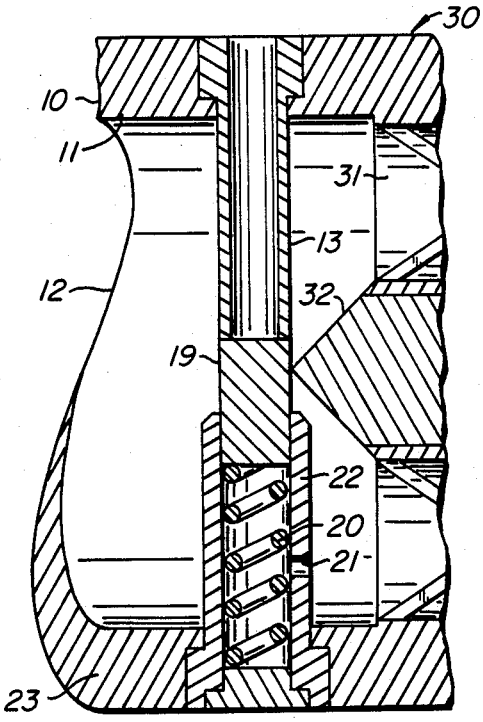

In referring to FIG. 3, it is noted that once ram 19 has sealed against casing 13, quill 16 can be effectively removed from the casing without any appreciable fluid loss from the system. This represents a significant advantage over mixing apparatus of the prior art for one is now capable of not only interrupting the introduction of a second fluid, but, when long interruptions take place, leading to the degradation of the second fluid, the quill or second fluid feed means can be completely removed from the system and cleaned and reintroduced to the mixing apparatus in a free flowing state.

The present invention also contemplates, in a preferred embodiment, the use of orifice 21 in biasing housing 22, for the discharge of any fluids which may become confined within said biasing housing. As ram 19 progresses within this biasing housing in response to pressure placed upon quill 16, it is advantageous to allow pressure equalization within the interior of biasing housing 22, which is accomplished by providing orifice 21 therein.

It was previously noted that the present invention is intended to be provided with mixing means located downstream of the discharge port of the quill for mixing the first and second fluids. In its preferred embodiment, it is intended that the downstream mixing means be comprised of a biscuit such as that disclosed in U.S. application Ser. No. 715,153, filed on Mar. 21, 1985, which was invented by the inventor of the present invention and assigned to the same assignee. Although the disclosure of the reference application is incorporated herein by reference, it generally can be stated that downstream mixing element 30 should generally comprise a biscuit section which possesses a plurality of openings 31 therein, and within the openings are located mixing elements which induce a rotational angular velocity to the fluid stream, passing therethrough. As being illustrative of such mixing elements are those disclosed in U.S. Pat. No. 3,923,288 which impart a rotational velocity to the fluid.

As a further preferred embodiment in the practice of the present invention, particularly when dealing with the mixing of fluids having widely disparate viscosities, is the use of conically shaped protrusion 32 whose apex is located upstream from the biscuit, and approximately at the discharge point of the second fluid from the quill. By providing this conical protrusion, one is able to increase the effective surface area of second fluid 15 to enhance the diffusability thereof and to guide the fluid within various mixing ports 31. Ideally, the apex of the conically shaped protrusion and discharge point of the second fluid are located approximately along the longitudinal center of the tubular conduit.

In view of the foregoing, modifications to the disclosed embodiments can be made while remaining within the spirit of the invention. Such modifications would be obvious to one skilled in this art, and, as such, the scope of the invention is to be limited only by the appended claims.

I claim:

1. A material mixing apparatus for the mixing of two or more fluids comprising:

A. a substantially tubular conduit for the passage of a first fluid;

B. a casing passing through said tubular conduit and eminating substantially radially toward the center of the conduit;

C. a quill which is slideably located within said casing, said quill being substantially hollow for the passage of a second fluid through said quill which is further characterized as possessing a discharge port for discharging said second fluid into a stream of said first fluid when the quill is radially extended within said casing, but which is blocked by the casing, when the quill is not fully extended; and D. mixing means located downstream of the discharge port of the quill for mixing said first and second fluids.

2. The apparatus of claim 1 wherein said quill is biased such that said discharge port is blocked unless pressure is radially applied to said quill.

3. The apparatus of claim 2 wherein said bias comprises a spring member contained within a biasing housing whose longitudinal axis substantially coincides with the longitudinal axis of said casing.

4. The apparatus of claim 3 wherein said spring member is biased against a ram which is also contained within said biasing housing, said ram contacting said quill for pushing the quill within said casing.

5. The apparatus of claim 4 wherein said ram is caused to abut said casing upon the removal of pressure from said quill.

6. The apparatus of claim 3 wherein said biasing housing is further characterized as possessing an orifice through a side wall thereof for the discharge of any fluids which would otherwise be confined within the spring housing.

7. The appartus of claim 1 wherein said quill is removable from said casing.

8. The apparatus of claim 1 wherein said mixing means comprises a plurality of openings and within said openings are located mixing elements which induce a rotational angular velocity to said first and second fluids.

9. The apparatus of claim 8 wherein said mixing means further possesses a conically-shaped protrusion whose apex is located upstream from said plurality of openings and approximately at the discharge point of said second fluid from said quill.

10. The apparatus of claim 9 wherein the apex of said conically shaped protrusion and discharge point of said second fluid are located approximately along the longitudinal center of said tubular conduit.

11. A material mixing apparatus for the mixing of two or more fluids comprising:

A. a substantially tubular conduit for the passage of a first fluid;

B. a casing passing through said tubular conduit and emanating substantially radially toward the center of the conduit;

C. a quill which is slideably located within said casing, said quill being substantially hollow for the passage of a second fluid therethrough, said quill being further characterized as possessing a discharge port for discharging said second fluid into a stream of said first fluid when the quill is radially extended within said casing, but which is blocked by the casing when the quill is not fully extended;

D. a biasing housing located along a longitudinal axis which substantially coincides with the longitudinal axis of the casing;

E. biasing means located substantially within said biasing housing;

F. ram means located between said biasing means and quill such that the quill is biased resulting in the discharge port being blocked by the casing unless pressure is placed upon the quill to extend the quill discharge port beyond the casing against opposing pressure of the biasing means and ram; and G. mixing means located downstream of said discharge port of the quill for mixing said first and second fluids.

12. The apparatus of claim 11 wherein said quill is removable from said casing.

13. The apparatus of claim 11 wherein said mixing means comprises a plurality of openings and within said openings are located mixing elements which induce a rotational angular velocity to said first and second fluids.

14. The apparatus of claim 13 wherein said mixing means further possessed a conically-shaped protrusion whose apex is located upstream from said plurality of openings and approximately at the discharge point of said second fluid from said quill.

15. The apparatus of claim 14 wherein the apex of said conically shaped protrusion and discharge point of said second fluid are located approximately along the longitudinal center of said tubular conduit.

* * * * *